United States Patent [19]

Vasiliev et al.

[11] 4,150,979

[45] Apr. 24, 1979

[54] METHOD OF CONTINUOUS PRODUCTION OF NODULAR CAST IRON

[76] Inventors: Evgeny A. Vasiliev, Kutuzovsky prospekt 1/7, kv. 37; Petr S. Sirotinsky, Profsojuznaya ulitsa 96, kv. 79, both of Moscow, U.S.S.R.; Dmitry P. Ivanov, deceased, late of Moscow, U.S.S.R., by Vitaly D. Ivanov, Administrator, ulitsa Vavilova 89, kv. 56, Moscow, U.S.S.R.

[21] Appl. No.: 826,050

[22] Filed: Aug. 19, 1977

[51] Int. Cl.[2] ..... C22C 33/08

[52] U.S. Cl. ..... 75/130 R; 75/53

[58] Field of Search ..... 75/130 R, 53

[56] References Cited

U.S. PATENT DOCUMENTS 3,527,597 9/1970 Dawson ..... 75/130 R

*Primary Examiner*—P. D. Rosenberg

*Attorney, Agent, or Firm*—Lackenbach, Lilling & Siegel

[57] ABSTRACT

A method, comprising melting in a furnace a ferriferrous charge with a carbon content of at least 2% by weight with the primary melt filling not more than 2/3 of the furnace volume, and introducing thereinto a solid iron, comprising at least one graphite-spheroidizing element taken in an amount exceeding by 4–10 times that of conventional nodular cast iron or supplying said graphite-spheroidizing element with foundry returns made up of nodular iron castings with a conventional content of said graphite-spheroidizing element, and with the subsequent melting and heating of the melt in said furance to a tapping temperature.

7 Claims, No Drawings

METHOD OF CONTINUOUS PRODUCTION OF NODULAR CAST IRON

The present invention relates to method for producing nodular cast iron in foundry furnaces.

Known in the art is a method of producing nodular iron periodically, said method includes the melting in a furnace of a charge, comprising iron and over 2% by weight carbon, which is followed by tapping the melt into a ladle and treating it therein with graphite-spheroidizing elements, such as magnesium, cerium or yttrium.

Carrying it into effect said method necessitates not only a furnace but a vessel for an iron melt to be treated therein with a graphite-spheroidizing element. The process of treating the iron melt heated to a high temperature is accompanied by a pyrogenous effect with vigorous ejection of metal and considerable smoke, contaminating the shop atmosphere and adversely affecting the operators' working conditions.

This is the reason why autoclave-type ladles have come into use, though they fail to eliminate the objectionable cooling of the melt with the process remaining batchwise in its nature.

Now either a graphite-spheroidizing element is placed in a ladle which is then filled with metal or said graphite-spheroidizing element is introduced into the melt poured in the ladle. In this case the graphite-spheroidizing element may be added in the form of rods, briquets, chips or shots. On some occasions the graphite-spheroidizing element is introduced into the lower near-the-bottom portion of the ladle through an appropriate hole in a ladle or furnace wall.

However, none of the above outlined methods is capable of precluding the cooling of the molten iron during its treatment with the graphite-spheroidizing element and providing for its subsequent heating, the iron being therefore preliminary overheated in the furnace, i.e. heated to higher temperatures approaching 1500° C.

The effect of said graphite-spheroidizing elements being limited in time as well as a considerable pyrogenous effect and a higher consumption of expensive graphite-spheroidizing elements—all these factors present serious problems in producing nodular cast iron.

Known also in the art is a method of continuous production of nodular iron wherein iron preliminarily smelted in furnaces and treated, as outlined above, in ladles is accumulated in an induction furnace pressurized by creating therein a neutral atmosphere or providing a layer of slag above the melt. However, the above method calls also for preliminary batchwise treatment in ladles of the melt, produced in separate furnaces, to accumulate it subsequently in said induction furnace.

The now-existing methods of producing nodular cast iron are noted for their high cost, since they involve substantial losses of graphite-spheroidizing elements due to their evaporation and oxidation on being introduced into an iron melt that is heated to high temperatures with due regard for its cooling in a ladle in the course of subsequent treatment and for retaining thereafter a temperature ensuring metal fluidity in making thin-section castings of intricate geometry. In this connection, some metal which has lost its casting properties owing to excessive cooling is discarded as wastes to preclude rejects in producing thin-walled castings. This in turn leads to considerable losses of both the metal and graphite-spheroidizing element.

As a result, the materials intended for remelting include not only waste metal, such as gates, heads and rejects, accounting for up to 40% of a heat, but an additional amount of poured off chilled iron treated with the graphite-spheroidizing element. During said remelting the graphite-spheroidizing element contained in metal wastes is lost completely.

In present day methods of producing nodular cast iron the shop atmosphere is considerably contaminated and crowded with auxiliary equipment.

In view of the ever-growing demand for nodular iron a need has arisen for a method for producing said iron in a continuous mode to meet the modern requirements of mechanical engineering for producing thin section castings of intricate shape.

The main object of the present invention is to provide a method for continuous melting of nodular cast iron, which is more efficient than the known methods by eliminating auxiliary equipment for batchwise treatment of iron with graphite-spheroidizing elements.

Another no less important object of the invention is to simplify the technology of producing nodular cast iron by melting a charge and treating the melt simultaneously with the graphite-spheroidizing elements.

Still another object of this invention is to improve the working conditions of furnace operators by preventing environmental and shop atmosphere pollution.

These and other objects are attained by providing a method for continuous production of nodular cast iron, comprising melting a ferriferrous charge with at least 2% by weight carbon to obtain a primary melt filling up to $\frac{2}{3}$ of the furnace volume, introducing solid iron into said melt to fill the entire volume of the furnace and subsequently heating the obtained secondary melt in the furnace to a melt tapping temperature, wherein, according to the invention, the solid iron added to the melt either contains at least one graphite-spheroidizing element in an amount exceeding by 4–10 times that of conventional nodular iron or said solid iron is introduced with foundry returns, comprising castings of nodular iron with a conventional content of the graphite-spheroidizing element.

The herein-proposed method makes it possible to treat the iron melt with the graphite-spheroidizing elements, introduced below the level (surface) of the iron melt in the furnace and at a lower temperature, which does not cause the burning of said graphite-spheroidizing element that takes place in treating the melt in ladles.

Moreover, by using the method of the invention the melting of the solid iron, introduced into said melt and containing an excessive amount of the graphite-spheroidizing element which passes into the melt, can be carried out simultaneously with the heating of the latter to a metal tapping temperature. In this case the metal should not be heated to very high temperatures, and the electric power requirements are thereby reduced.

As the molten iron is treated with the graphite-spheroidizing element in the furnace, there is no need whatsoever for additional equipement, such as vessels wherein the iron is treated with said graphite-spheroidizing elements in foundries using the known procedures.

The herein-proposed method substantially reduces atmosphere pollution in foundries and the working conditions of furnace operators are improved, hence there is no need for powerful pressure-exhaust ventilation and the process runs continuously.

An addition of nodular iron returns eliminates losses of the graphite-spheroidizing elements with the rejects employed for producing nodular graphite.

It is expedient that magnesium and/or cerium be used as graphite-spheroidizing elements. Said elements rank among the most efficient and are available for mass production.

Given hereinbelow are exemplary embodiments of the present invention.

EXAMPLE 1

20 kg of conventional foundry iron were melted in a 30 kg induction furnace with a neutral lining, with the melt filling ⅔ of the furnace volume. Next a solid pig iron of a similar chemical composition, but comprising additionally from 0.2 to 0.5% by weight magnesium (i.e. with magnesium contents exceeding by 4–10 times that of conventional nodular iron), was introduced into the melt accommodated in the furnace. Upon melting and heating the secondary melt to a tapping temperature, varying in a 1380°–1400° C. range, one third of the melt volume (10 kg) was tapped into a ladle for subsequent pouring into molds, and the furnace was again charged with 10 kg of a solid pig iron with magnesium contents ranging from 0.2 to 0.5% by weight. The introduction of the solid iron into the furnace as well as its melting and the heating of a secondary melt were not accompanied by a pyrogenous effect and smoke release, with the process running smoothly like during conventional remelting of iron. The process was carried on continuously for 5 hrs. During the entire melting operation the residual magnesium content (0.08–0.12% by weight) did not change, with the castings being made of nodular iron. As for the mechanical properties of iron after short-term annealing they were: $\delta_b = 65$ kgf/cm$^2$ and $\delta = 7$–$8\%$, where $\delta_b$-tensile strength and $\delta$-elongation.

EXAMPLE 2

For speeding up the beginning of the melting process in a 60 kg induction furnace a primary iron melt was obtained, said melt filling ⅔ of the furnace volume; the melt was treated with cerium by a conventional method, whereafter a solid pig iron was introduced into the melt accommodated in said induction furnace. The pig iron contained from 0.2 to 0.5% by weight cerium and foundry returns (gates and heads) of conventional nodular iron and occupying 30% of the furnace volume. Test data obtained during continuous melting were similar to those quoted in Example No. 1.

EXAMPLE 3

28 kg of a primary charge, comprising conventional foundry iron were melted in a 50 kg induction furnace. After that a solid pig iron of a similar chemical composition but with 0.2% by weight cerium and magnesium was introduced into the melt. Upon smelting said iron with a higher cerium and magnesium content to fill the furnace working volume and upon heating the melt to a temperature of 1340° C., it was poured at a low pressure into molds to produce castings with a wall thickness varying within 2–20 mm. Following that a solid pig iron with 0.2% by weight magnesium and cerium and up to 25% by weight of returns were charged into the furnace beneath the metal surface (below its level), with the returns containing conventional nodular iron. The process was stable and mechanical properties of specimens, as revealed by tests, were similar to those obtained in Example No. 1. As for the graphite-spheroidizing element, use can be made of yttrium as well.

For casting at elevated temperatures (1450° C.) a solid iron with 0.8% by weight magnesium is smelted in an induction furnace. In this case more fine graphite nodules were obtained with the iron exhibiting better plastic characteristics ($\delta = 10$–$12\%$).

Thus, the method of the invention, as it was borne out by the test data, has a number of advantages over similar known procedures. For example, by treating the primary iron melt in a furnace with a solid iron containing a greater amount of the graphite-spheroidizing elements, with the iron being introduced below the metal surface (beneath the level of molten metal in the furnace) at a relatively low temperature of said melt it is possible to bring down power requirements and the losses of the graphite-spheroidizing element. Moreover, the process of melting nodular cast iron proceeds continuously and steadily without the pyrogenous effect and with the ensuing alleviation of the operators' working conditions due to lower pollution of the shop atmosphere and lower amount of auxiliary equipment required.

What we claim is:

1. A method for continuous production of nodular iron comprising: melting, in a furnace, a foundry charge of cast iron containing at least 2% by weight carbon to obtain a primary melt filling up to ⅔ of the furnace volume; introducing solid iron into the primary melt, to form a secondary melt, said solid iron containing 0.2 to 0.5% by weight of a graphite-spheroidizing element, to fill the entire furnace volume, thereby effecting spheroidization of the melt, and subsequently heating the secondary melt in said furnace to a melt tapping temperature.

2. The method of claim 1, wherein nodular iron foundry returns containing the graphite-spheroidizing elements are added to the primary melt simultaneously with said iron having a higher content of the graphite-spheroidizing element, with the total amount of said iron and foundry returns being sufficient to fill completely the entire working volume of the furnace.

3. The method of claim 1, wherein magnesium is employed as a graphite-spheroidizing element.

4. The method of claim 1, wherein cerium is employed as a graphite-spheroidizing element.

5. The method of claim 1, wherein said graphite-spheroidizing element is selected from the group consisting of magnesium, cerium, yttrium, and mixtures thereof.

6. The method of claim 5, wherein yttrium is employed as a graphite-spheroidizing element.

7. The method of claim 5, wherein a mixture of magnesium and cerium is employed as the graphite-spheroidizing elements.

* * * * *